US006556192B2

(12) United States Patent
Jang

(10) Patent No.: US 6,556,192 B2
(45) Date of Patent: Apr. 29, 2003

(54) APPARATUS AND METHOD FOR PREVENTING A WHITE-SCREEN ERROR IN A LIQUID CRYSTAL DISPLAY DEVICE

(75) Inventor: Kyeong-Kun Jang, Pyongtaek-shi (KR)

(73) Assignee: LG. Philips LCD Co., Ltd., Seoul (KR)

( * ) Notice: Subject to any disclaimer, the term of this patent is extended or adjusted under 35 U.S.C. 154(b) by 195 days.

(21) Appl. No.: 09/749,451

(22) Filed: Dec. 28, 2000

(65) Prior Publication Data

US 2001/0011980 A1 Aug. 9, 2001

(30) Foreign Application Priority Data

Jul. 5, 1999 (KR) ..... 1999-26942

(51) Int. Cl.[7] ..... G09G 3/36
(52) U.S. Cl. ..... 345/204; 345/87
(58) Field of Search ..... 345/87, 98, 100, 345/88, 89, 204, 205, 92

(56) References Cited

U.S. PATENT DOCUMENTS 5,940,069 A * 8/1999 Moon ..... 345/211
6,219,016 B1 * 4/2001 Lee ..... 345/87
6,400,211 B1 * 6/2002 Yokomizo et al. ..... 327/536
2001/0022734 A1 * 9/2001 Sato ..... 363/21.08

* cited by examiner

*Primary Examiner*—Richard Hjerpe
*Assistant Examiner*—Ronald Laneau
(74) *Attorney, Agent, or Firm*—McKenna Long & Aldridge LLP

(57) ABSTRACT

A system and method for preventing a white-screen error in a liquid crystal display (LCD) device operates by detecting an output voltage signal from a DC/DC converter and reducing a time delay between the output voltage signal and a data signal for the LCD gradually by a fixed value until a timing problem between the output voltage signal and the data signal is overcome. A software reset is executed when the time interval between the output voltage signal and the data signal is too great, causing the output voltage signal to shut down before the data signal is turned on. The process is repeated until the timing is proper such that the output voltage signal is detected to remain when the data signal is output. If the time delay is reduced to a predetermined threshold, then it is determined that a malfunction has occurred, and an alert is provided to a user.

32 Claims, 4 Drawing Sheets

APPARATUS AND METHOD FOR PREVENTING A WHITE-SCREEN ERROR IN A LIQUID CRYSTAL DISPLAY DEVICE

This application is based on Korean Patent Application No. 1999-26942, filed on Jul. 5, 1999, which is hereby incorporated by reference for all purposes as if fully set forth herein.

BACKGROUND OF THE INVENTION

1. Field of the Invention

The present invention relates to a liquid crystal display (LCD) device, and more particularly, to a method and apparatus that prevents a white-screen error from occurring in the LCD device, and an LCD device incorporating the method and apparatus.

2. Discussion of the Related Art

LCD devices including display and drive portions are widely adopted as a display device for notebook computers or laptop computers because of a smaller size than conventional cathode ray tubes (CRTs). And recently, as the LCD devices become to display natural-like colors, desktop computers arc also adopting the LCD device as a display device. The LCD device has advantages of low power consumption, low electromagnetic radiation, and small size compared with a CRT.

Now, with reference to FIG. 1, a detailed explanation of the drive portion of an LCD device used for a desktop computer will be provided.

An interface 10 receives horizontal synchronous signals "HSYNC," vertical synchronous signals "VSYNC," and image data signals "DATA." The interface 10 is electrically connected (hereinafter, connected) with an interface controller 12 and an LCD controller 14, which is connected with a DC/DC converter 16. In addition, the LCD controller 14 is connected with gate-line driving circuits 18 and data-line driving circuits 20, while the gate-line driving circuits 18 and data-line driving circuits 20 are connected with gate lines and data lines of an LCD panel 22. Though not shown in FIG. 1, the LCD panel 22 has a plurality of unit pixels arranged in a matrix shape, and each unit pixel has a thin film transistor (TFT). Gate and source electrodes of the TFTs are connected by means of the gate lines and data lines with the gate-line driving circuits 18 and the data-line driving circuits 20, respectively.

From power source devices, or power supply circuits (not shown), a direct current (DC) supply voltage, for example, 3.3 VDC is applied to the DC/DC converter 16 and the LCD controller 14. Therewith, the DC/DC converter 16 provides first, second, and third output power source voltages of −5, 16, and 8.7 VDC. Among the output power source voltages, the first and second output power source voltages −5 and 16 VDC are supplied for the gate-line driving circuits.

As the drive portion including the interface 10 et al. receives video signals from a video card of the desktop computer, the display portion including the LCD panel 22 displays images. The role and operation of each device shown in FIG. 1 will be explained hereinafter.

When the video card transmits the video signals including HSYNC and VSYNC to the interface 10, the interface 10 processes them such that images displayed by the LCD panel 22 coincide with preset resolution and optimum display size. Herein, the interface controller 12 transmits interface control signals to the interface 10 such that the interface 10 operates according to the interface control signals. As a result, the interface 10 produces data signals which are applied to the LCD controller 14.

The LCD controller 14 transmits video data signals to the data-line driving circuits 20 according to some clock signals, and applies gate start signals and timing signals to the gate-line driving circuits 18. At this point, the DC/DC converter 16, which is supplied 3.3 VDC from the power source (not shown), provides a plurality of different DC voltage levels to the gate-line driving circuits 18 and the data-line driving circuits 20, respectively.

The data-line driving circuits 20 and the gate-line driving circuits 18 transmit pixel data and gate signals to the LCD panel 22, and the LCD panel 22 displays certain images from the pixel data signals according to the gate signals.

Hereinafter, a white screen error of the above-mentioned LCD device will be explained with reference to FIG. 2.

As shown, the LCD device conventionally has a delay time between the output power source voltages, specifically the first and second output power source voltages that are applied to the gate-line driving circuits, and the data signals that are respectively applied by the DC/DC converter 16 and the interface 10. That is to say, the output power source voltages begin to increase at a time period "T1" and reach their normal values at a subsequent time period "T2" while the data signals begin at a further subsequent time period "T3." Therefore, the output power source voltages go ahead of the data signals by the time period "T2," which is conventionally designed to be less than 20 ms inclusive. In other words, since there conventionally occurs an abnormal transient phase in the output power source voltages when the power source of the desktop computer is turned on or off, the output power source voltages should begin ahead of the data signals by a preset time period to assure a normal operation of the LCD device, namely, to exclude the abnormal state where the data signals are applied during the transient period "T1" of the output power source voltages.

However, when the delay time is too long, the output power source voltage is applied to the gate-line driving circuit too long without the display data signals being applied to the data-line driving circuit. In that abnormal case, an over-current is applied to the gate electrode of the TFT in the LCD panel such that a surge protector or breaker of the DC/DC converter powers down all of the output power source voltages. And as a result, while a back light is still illuminating, there exists no image data displayed on the LCD panel such that only a white color is shown to users, which is called as the white-screen error. The white screen error continues until the users turn off the main power for the desktop computer.

The above-mentioned problem causes users to distrust the overall product, such that repair service costs of venders are increased.

SUMMARY OF THE INVENTION

Accordingly, the principles of the present invention relate to a liquid crystal display device that is designed to substantially obviate one or more of the problems due to the limitations and disadvantages of the related art.

It is an object of the present invention to provide a method and apparatus for preventing the white-screen errors.

To achieve the above object, in one aspect the present invention provides A driving portion of a liquid crystal display device, comprising a data-line driving circuit; a gate-line driving circuit; an interface outputting data signals; a liquid crystal display controller receiving the data signals and outputting display data signals to the data-line driving circuit and timing signals to the gate-line driving circuit; a DC/DC converter supplying a plurality of output power source voltages to the gate-line driving circuit and the data-line driving circuit; a voltage detector detecting a voltage level of one of the output power source voltages supplied by the DC/DC converter and outputting a feedback signal; and an interface controller receiving the feedback signal from the voltage detector, outputting enable signals to the interface and to the DC/DC converter, and outputting a control signal to advance the data signals when the detected voltage level of the one output power source voltage is less than 90% of a preset voltage level.

Preferably, the voltage detector includes a transistor having gate, source and drain electrodes and being turned on and off according to the output power source voltage from the DC/DC converter.

Preferably, the transistor is a thin film transistor.

Also preferably, the voltage detector includes a first resistor electrically connecting the gate electrode of the transistor with an output terminal of the DC/DC converter and a second resistor electrically connecting the drain electrode of the transistor with the liquid crystal display controller, wherein the source electrode of the transistor is connected to ground, and wherein the drain electrode of the transistor is electrically connected with the interface controller.

The driving portion further includes an alarm device alerting users only when the feedback signals are abnormal in spite of outputting the data signals and the output power source voltage at the same time.

In the driving portion, the alarm device is preferably a light-emitting device emitting light according to a control signal applied from an interface controller.

Preferably, the light-emitting device includes a light-emitting diode and a resistor, wherein the light-emitting diode includes an anode electrode electrically connected with the interface controller, and a cathode electrode electrically connected with a first end of the resistor, and wherein a second end of the resistor is connected with ground.

In another aspect of the invention, a method of driving a liquid crystal display (LCD) device comprises providing a data signal for displaying an image on the liquid crystal display panel; supplying an output voltage signal used to drive the liquid crystal display panel to display the image; detecting a voltage level of the output voltage signal; providing a feedback signal indicating whether the voltage level exceeds a predetermined threshold; and in response to the feedback signal, adjusting a time interval between the output voltage signal and a start of the data signal.

Additional features and advantages of the invention will be set forth in the description that follows, and in part will be apparent from the description, or may be learned by practice of the invention. The objectives and other advantages of the invention will be realized and attained by the structure particularly pointed out in the written description and claims hereof as well as the appended drawings. However, it should be understood that the written description and the specific examples, while indicating preferred embodiments of the invention, are given by way of illustration only. Various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF AN ILLUSTRATED EMBODIMENT

Reference will now be made in detail to an embodiment of the present invention, an example of which is illustrated in the accompanying drawings.

Figure 3:
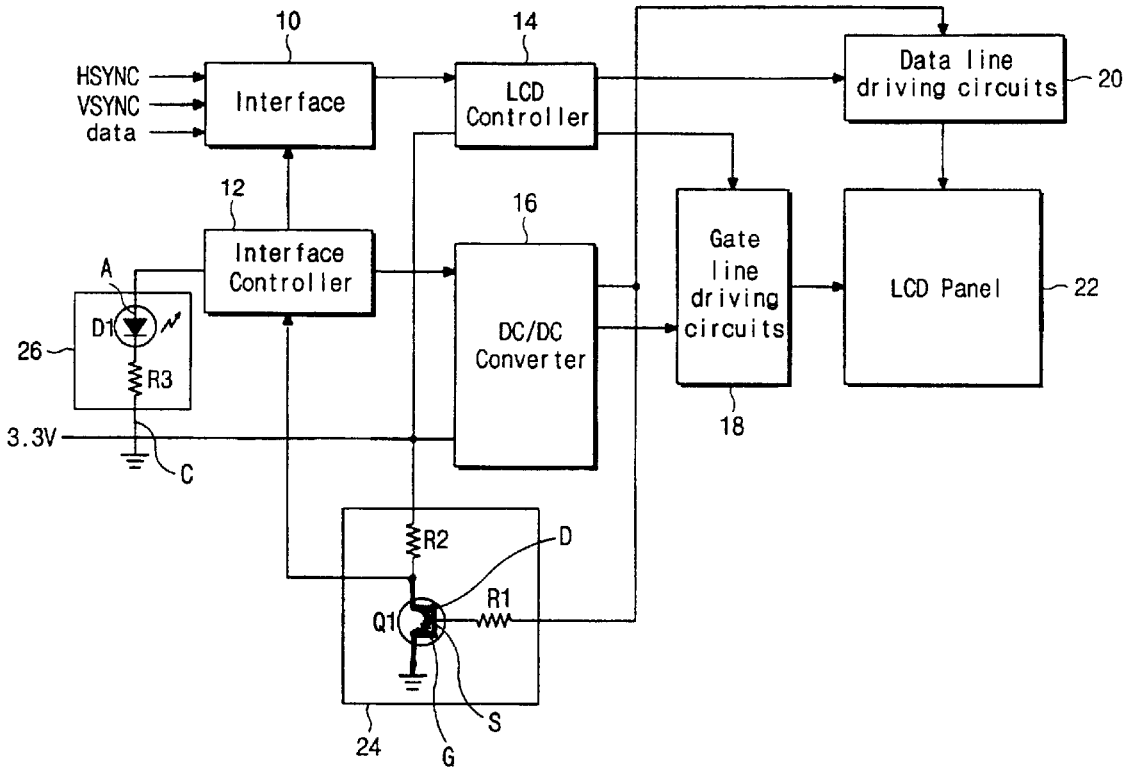
FIG. 3 is a block diagram illustrating a driving portion and displaying portion according to a preferred embodiment of the present invention.

FIG. 3 shows a configuration of an LCD device used for desktop computers.

Figure 1:
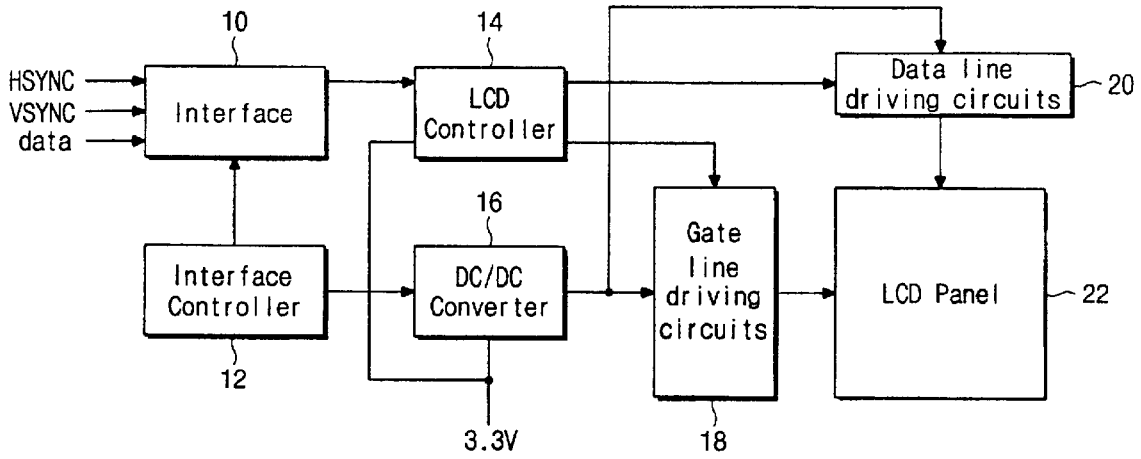
(related art) Figure 1
FIG. 1 is a block diagram illustrating driving portion and displaying portion of a conventional liquid crystal display device used for desktop computers.

As shown, an interface 10 receives horizontal synchronous signals "HSYNC," vertical synchronous signals "VSYNC," and image data signals "DATA." The interface 10 is electrically connected (hereinafter, connected) with an interface controller 12 and an LCD controller 14, which is connected with a DC/DC converter 16. In addition, the LCD controller 14 is connected with gate-line driving circuits 18 and data-line driving circuits 20, while the gate-line driving circuits 18 and data-line driving circuits 20 are connected with gate lines and data lines of an LCD panel 22. Though not shown in FIG. 1, the LCD panel 22 has a plurality of unit pixels arranged in a matrix, and each unit pixel has a thin film transistor (TFT). Gate and source electrodes of the TFT are connected by the gate lines and data lines with the gate-line driving circuits 18 and the data-line driving circuits 20, respectively. The gate-line driving circuits 18 and the data-line driving circuits 20 have a tape automated bonding (TAB) shape and are mounted between printed circuit boards (PCBs).

The interface 10 receives video signals output by a video card mounted in a main body of the desktop computer. Namely, when a video card (not shown) of the desktop computer transmits video signals including HSYNC, VSYNC and data signals to the interface 10, the interface 10 processes them such that certain images, displayed on the LCD panel 22, coincide with preset resolution and optimum display size. Herein, the interface controller 12 transmits interface control signals to the interface 10 such that the interface 10 operates according to the interface control signals. As a result, the interface 10 produces data signals which are applied to the LCD controller 14. In turn, the interface controller 14 produces video data signals which are provided to the data-line driving circuits 20, and gate start and timing signals which are provided to the gate-line driving circuits 18.

One or more output power source voltages from the DC/DC converter 16 are applied to the gate-line and data-line driving circuits 18 and 20.

The data-line driving circuits 20 and the gate-line driving circuits 18 transmit pixel data and gate signals to the LCD panel 22, and the LCD panel 22 displays certain images from the pixel data signals according to the gate signals.

One of the output power source voltages from the DC/DC converter 16 is also connected with a gate electrode "G" of a transistor "Q1" through a first resistor "R1." A source electrode "S" of the transistor Q1 is connected to a ground, and a drain electrode "D" is connected to two lines, such that a first line is connected through a second resistor "R2" with a main power source voltage, for example 3.3 VDC, that is input to the DC/DC converter 16, while a second line is connected with the interface controller 12. Further, the interface controller 12 is connected with an anode electrode "A" of a light-emitting diode (LED) "D1," and the cathode electrode "C" of the LED D1 is connected to ground through a third resistor "R3."

A voltage detector 24 preferably includes the transistor Q1, and first and second resistors R and R2. The voltage detector 24 detects the output power source voltages from the DC/DC converter 16 and applies feedback signals to the interface controller 12. Various modifications will be applicable to the voltage detector 24, if only the abovementioned operation can be achieved.

Figure 2:
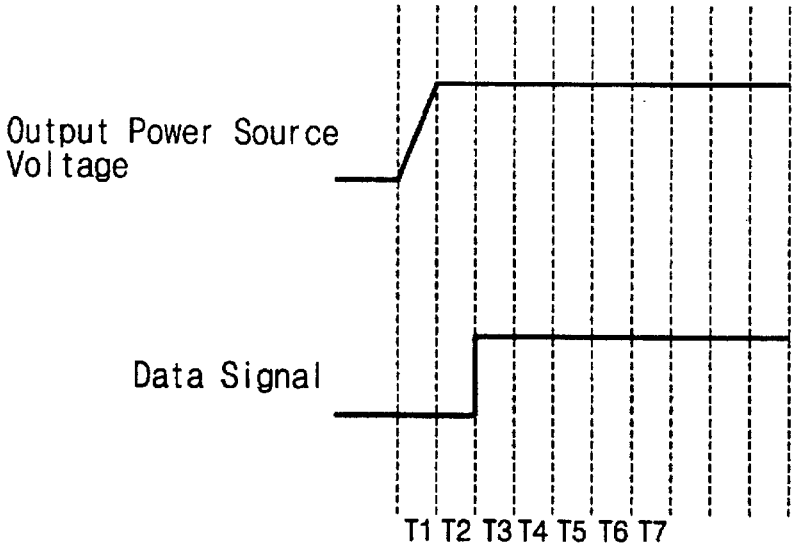
(related art) Figure 2
FIG. 2 illustrates signal waveforms of output power source voltage and data signals in the driving portion of the conventional liquid crystal display device of FIG. 1.

Further, an alarm device 26 includes an LED D1 and a third resistor R3 to notify the users of an abnormal state, a white-screen error, as described in FIG. 2. Various modifications will also be applicable to the alarm device 26, if only the above-mentioned operation can be achieved.

The role and operation of each component of the LCD device according to the preferred embodiment of the present invention will be explained hereinafter.

The horizontal synchronous signals "HSYNC," vertical synchronous signals "VSYNC," and image data signals "DATA" are input to the interface 10. According to the interface control signals from the interface controller 12, the interface 10 processes and transmits the data signals to the LCD controller 14. After a preset time interval, the LCD controller 14 transmits the display data signals to the data-line driving circuits.

When the power source (not shown) applies 3.3 VDC to the DC/DC converter 16, the DC/DC converter 16 converts it and provides first, second, and third output power source voltages of, for example, −5, 16, and 8.7 VDC. Among the output power source voltages, the first and second output power source voltages −5 and 16 VDC are supplied to the gate-line driving circuits 18, while 8.7 VDC is supplied to the data-line driving circuits 20.

At this point, the first and second output power source voltages are also applied to the gate electrode G of the transistor Q1 of the voltage detector 24 such that the transistor Q1 is turned on only if the voltage level is above a preset value. And further, through drain signals from the drain electrode D of Q1, the interface controller 12 recognizes whether the DC/DC converter 16 supplies the output power source voltages or not.

For example, in the case of the 8.7 VDC being supplied from the DC/DC converter 16, when the DC/DC converter supplies the third output power source voltage of 8.7 VDC normally, the transistor Q1 is turned on to apply a first feedback signal, a LOW signal, to the interface controller 12. But, when the third output power source voltage of 8.7 VDC is abnormally stopped, the transistor Q1 is turned off such that a second feedback signal, a HIGH signal, is applied to the interface controller 12. Namely, depending on the feedback signals, it is possible to detect whether the DC/DC converter 16 operates normally or not.

The above-mentioned method of checking the output power source voltages is to prevent the white-screen error. Now, referring to FIG. 4, a detailed explanation of a flow chart of the above-mentioned method will be provided.

As shown, in a first step, S110, the interface controller 12 transmits first and second enable signals to the interface 10 and the DC/DC converter 16, respectively, for outputting the data signals and the output power source voltages.

In a second step, S120, the DC/DC converter 16 outputs the output power source voltages according to the second enable signal, and, after a delay time or a timing offset of N microseconds, the interface 10 outputs the data signals. The timing offset N is preferably 100 to 200 microseconds, which is changeable according to design concepts of the various manufacturing venders.

In a third step, S130, the interface controller 12 determines whether the timing offset N is less than a first constant "α," or not. Herein, the first constant "α" is assumed to be zero, though it is changeable according to design concepts of the various manufacturing venders. Further, values of the first constant "α," depend on whether hardware of the driving portions is out of order, or not.

In a fourth step, S140, when the timing offset N is greater than 0, the interface controller 12 determines whether the feedback signal from the transistor Q1 is LOW or not. If the feedback signal is the LOW signal, the process ends since this means that the DC/DC converter operates normally. At this point, any of the output power source voltages from the DC/DC converter can be used for applying the feedback signal. In this preferred embodiment, the 8.7 VDC output power source voltage is preferably employed. In the case of using the −5 VDC output power source voltage for the feedback signal, the interface controller 12 determines the normal operation of the DC/DC converter according to whether the feedback signal is HIGH, or not, instead.

Still in the fourth step, S140, if the feedback signal is not LOW, the process proceeds to a fifth step, S150. Therein, the timing offset N is changed to a corrected timing offset N-β to prevent the white-screen error. A second constant β is preferably 1 μs in this preferred embodiment, though it is changeable according to design concepts of the various manufacturing venders.

Next, in a sixth step, S160, a software reset is facilitated such that it returns to the first step, S110, and the above-mentioned steps are repeated with the corrected timing offset N-1. Unless the feedback signal is LOW, the process repeats steps S140–S160 until the timing offset reaches 0.

As the timing offset is determined to be equal to 0 in the third step S130, the process proceeds to a seventh step, S170. In the seventh step, the LED D1 of the alarm device 26 operates to alert the user that the hardware of the DC/DC converter 16 is out of order. Thereafter, the process ends.

Figure 4:
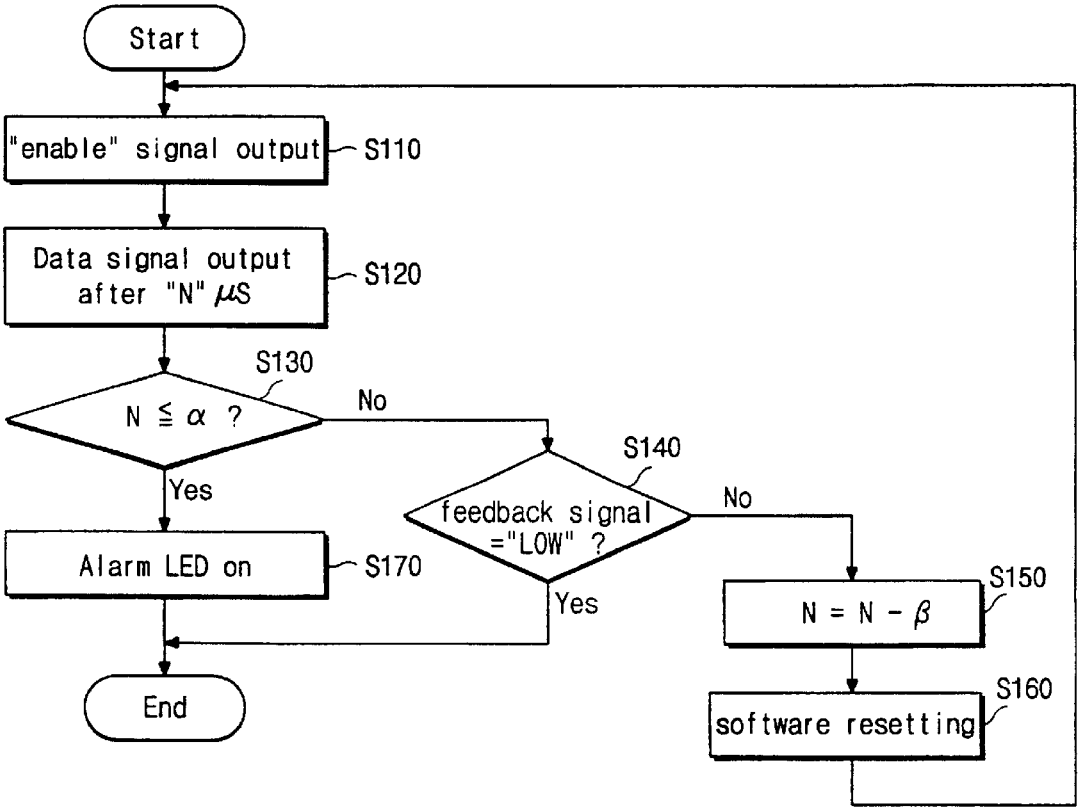
FIG. 4 is a flow chart illustrating a program stored in the interface controller.

According to design concepts of manufacturing venders, various methods are applicable for alerting the user. For example, the LED D1 preferably blinks its light on and off, or a plurality of LEDs can be used. Further, an alarm sound can be used instead of the LED. The third resistor R3 of the alarm device 26 provides a voltage loss for the LED D1 such that an appropriate voltage is applied to the LED D1. And the above-mentioned flow chart shown in FIG. 4 is stored as a program in a read only memory (ROM) inside or outside of the interface controller 12.

Preferably, the timing offset N that is preset in the interface controller 12 corresponds to a time difference between a 90% value point of the output voltage and a rising edge, or a start point, of the data signals. A greater timing offset N means that the output power source voltages appear further ahead of the data signals. Even though the timing offset N is preset in the interface controller 12, since the hardware can not be perfect, operation errors such as the white-screen error can still occur. However, as described previously, the preferred embodiment of the present invention prevents the white-screen error using the above-mentioned feedback system.

That is to say, if the offset timing is decreased by 1 $\mu$s, the interface controller 12 applies a control signal to the interface 10 such that software reset is facilitated and the data signals are advanced. The software reset plays the same role as a conventional turning off and on of a computer system in the desktop computer.

Figure 5:
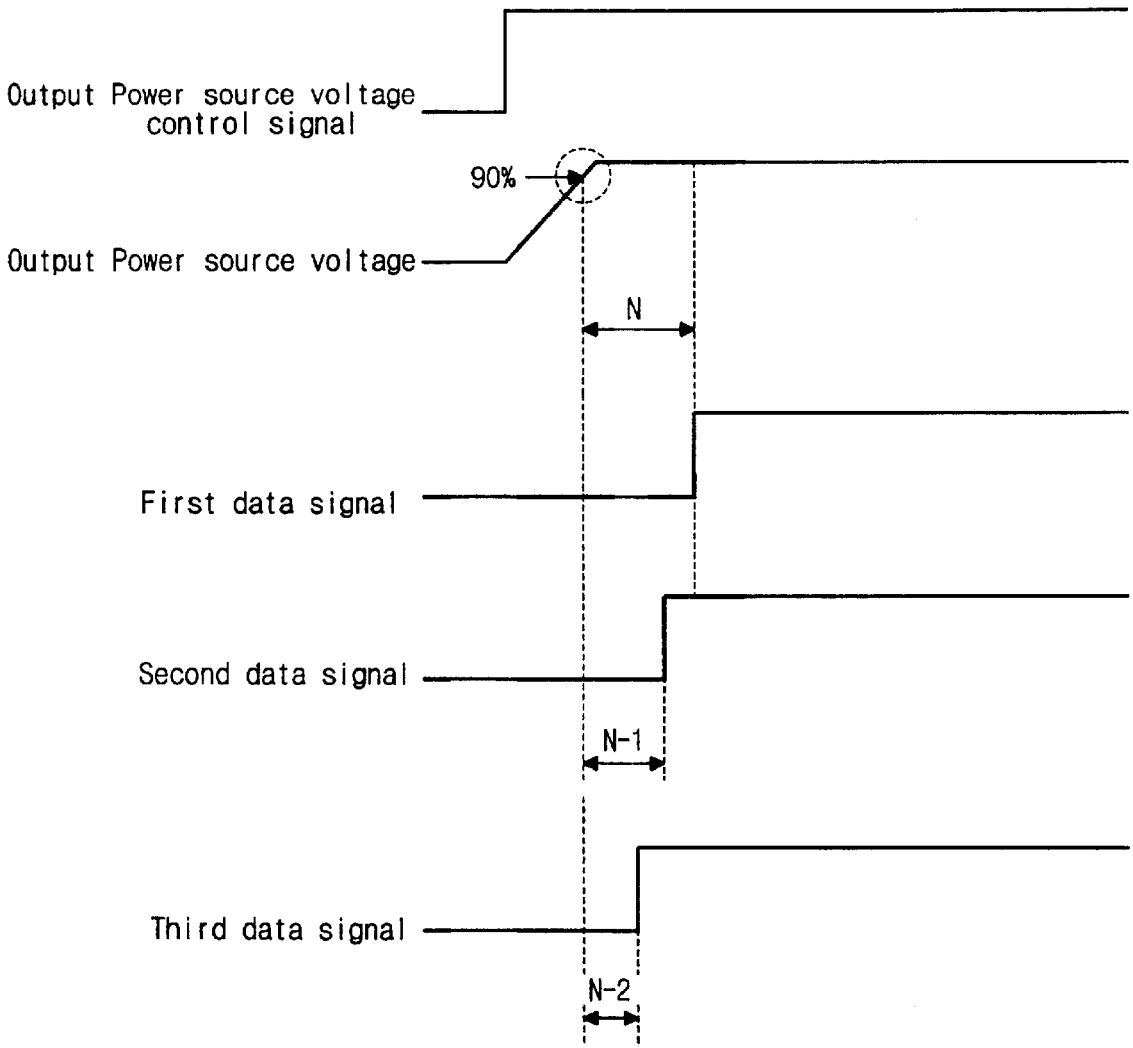
FIG. 5 is a graph illustrating waveforms of the data signals and output power source voltage applied from the driving portion of the liquid crystal display device for a desktop computer.

As shown in FIG. 5, when the timing offset N is decreased by 1 to be N-1, the software reset is facilitated and the interface 10 outputs a second data signal that is advance by 1 $\mu$s with respect to the first data signal. Similarly, a third data signal further is advanced by 1 $\mu$s with respect to the second data signal. Accordingly, the problem that the data signals are applied before a stabilization of the output power source voltage is eliminated and the white-screen error is prevented.

Further, as shown in FIG. 5, the output power source voltage is assumed to reach the stabilization when it reaches the 90% point, so the 90% point of the output power source voltage is compared with the first to third (and further) data signals.

In short, the output power source voltage from the DC/DC converter is detected at first, and the timing offset between the data signal and the output power source voltage is gradually decreased such that the white-screen error that occurs randomly due to the timing problem between the output power source voltage and the data signal is overcome.

While the invention has been particularly shown and described with reference to the preferred embodiments thereof, it will be understood by those skilled in the art that the foregoing and other changes in form and details may be made therein without departing from the spirit and scope of the invention. Thus, it is intended that the present invention covers the modifications and variations of this invention provided they come within the scope of the appended claims and their equivalents.

What is claimed is:

1. A driving portion of a liquid crystal display device, comprising:

a data-line driving circuit;

a gate-line driving circuit;

an interface outputting data signals;

a liquid crystal display controller receiving the data signals and outputting display data signals to the data-line driving circuit and timing signals to the gate-line driving circuit;

a DC/DC converter supplying a plurality of output power source voltages to the gate-line driving circuit and the data-line driving circuit;

a voltage detector detecting a voltage level of one of the output power source voltages supplied by the DC/DC converter and outputting a feedback signal; and an interface controller receiving the feedback signal from the voltage detector, outputting enable signals to the interface and to the DC/DC converter, and outputting a control signal to advance the data signals when the detected voltage level of the one output power source voltage is less than 90% of a preset voltage level.

2. The driving portion according to claim 1 wherein the voltage detector includes a transistor having gate, source and drain electrodes, and being turned on and off according to the one of the output power source voltages from the DC/DC converter.

3. The driving portion according to claim 2 wherein the transistor is a thin film transistor.

4. The driving portion according to claim 2 wherein the voltage detector includes:

a first resistor electrically connecting the gate electrode of the transistor with an output terminal of the DC/DC converter;

and a second resistor electrically connecting the drain electrode of the transistor with the liquid crystal display controller, wherein the source electrode of the transistor is connected to ground, and wherein the drain electrode of the transistor is electrically connected with the interface controller.

5. The driving portion according to claim 1, further comprising an alarm device alerting a user only when the feedback signal is abnormal in spite of outputting the data signals and the output power source voltage at a same time.

6. The driving portion according to claim 5, wherein the alarm device is a light-emitting device emitting light according to a second control signal applied from the interface controller.

7. The driving portion according to claim 6, wherein the light-emitting device includes:

a light-emitting diode; and a resistor, wherein the light-emitting diode includes an anode electrode electrically connected with the interface controller, and a cathode electrode electrically connected with a first end of the resistor, and wherein a second end of the resistor is connected with ground.

8. In a liquid crystal display device including:

a data-line driving circuit, a gate-line driving circuit, an interface controller outputting control signals according to a preset program, an interface receiving video signals and converting said video signals to data signals according to a preset resolution and display size, a liquid crystal display controller receiving the data signals from the interface and outputting display data signals to the data-line driving circuit and a timing signal to the gate-line driving circuit, a DC/DC converter receiving a power source voltage and converting the power source voltage into a plurality of output power source voltages, and a liquid crystal display panel receiving the display data signals from the data-line driving circuit and displaying images according to a signal from the gate-line driving circuit, a method of preventing a white-screen error, comprising:

(a) transmitting enable signals from the interface controller to the DC/DC converter and the interface;

(b) outputting the data signals from the interface after a timing offset N from a time of transmitting the enable signals;

(c) determining whether the timing offset N is less than a first constant a, the first constant a being preset corresponding to a time period indicating a hardware malfunction;

(d) when the timing offset N is greater than the first constant α, determining whether the output power source voltage supplied from the DC/DC converter is normal;

(e) decreasing the timing offset by a second constant β when the output power source voltage is abnormal; and (f) repeating steps (a) through (e) until the output power source is determined to be normal.

9. The method according to claim 8 wherein whether the output power source voltage supplied from the DC/DC converter is normal is determined by a feedback signal from a voltage detector electrically connected with an output terminal of the DC/DC converter.

10. The method according to claim 9 wherein the voltage detector includes a transistor having gate, source and drain electrodes and being turned on and off according to the one of the output power source voltages from the DC/DC converter.

11. The method according to claim 10 wherein the transistor is a thin film transistor.

12. The method according to claim 10 wherein the voltage detector includes:

a first resistor electrically connecting the gate electrode of the transistor with an output terminal of the DC/DC converter, and a second resistor electrically connecting the liquid crystal display controller with the drain electrode of the transistor, the source electrode of the transistor being connected to ground, and the drain electrode of the transistor being electrically connected with the interface controller.

13. The method according to claim 8, further comprising:

when the timing offset N is less than the first constant α, alerting the hardware malfunction of the DC/DC converter via an alarm device.

14. The method according to claim 13, wherein the alarm device is a light-emitting device emitting light according to one of the control signals from the interface controller.

15. The method according to claim 14, wherein the light-emitting device includes:

a light-emitting diode; and a resistor, wherein the light-emitting diode includes an anode electrode electrically connected with the interface controller, and a cathode electrode electrically connected with a first end of the resistor, and wherein a second end of the resistor is connected with ground.

16. The method according to claim 8, further comprising facilitating a software reset before repeating to step (a).

17. A liquid crystal display (LCD) device, comprising:

a liquid crystal display panel having a plurality data lines, a plurality of gates lines, and a plurality of TFTs each connected with one of the gate lines and one of the data lines;

an interface receiving a video signal and outputting a data signal;

a liquid crystal display controller receiving the data signal and outputting a video data signal and a timing signal;

a data-line driving circuit receiving the video data signal from the liquid crystal display controller and providing pixel data to the data lines;

a gate-line driving circuit receiving the timing signal from the liquid crystal display controller and providing gate signals to the gate lines;

a DC/DC converter supplying an output power source voltage to the one of the data-line driving circuit and the gate line driving circuit;

a voltage detector detecting a voltage level of the output power source voltage supplied by the DC/DC converter and outputting a feedback signal; and an interface controller receiving the feedback signal from the voltage detector, outputting enable signals to the interface and to the DC/DC converter, and outputting a control signal to advance the data signal when the detected voltage level of the output power source voltage is less than a preset voltage level.

18. The LCD device of claim 17, wherein the interface controller advances the data signal by a predetermined time offset, β.

19. The LCD device of claim 17, wherein the interface controller repeatedly supplies the feedback signal to advance the data signal until the data signal is advanced to within a predetermined time interval α of the enable signal supplied to the interface.

20. The LCD device of claim 19, wherein the interface controller repeatedly advances the data signal by a predetermined time offset, β.

21. The LCD device of claim 18, further comprising an alarm which alerts a user of a malfunction when the data signal is advanced to within the predetermined time interval α of the enable signal supplied to the interface.

22. The LCD device of claim 19, wherein the alarm comprises a light-emitting display.

23. A liquid crystal display (LCD) device, comprising:

a liquid crystal display panel;

means for supplying a data signal for displaying an image on the liquid crystal display panel;

means for supplying an output voltage signal used to drive the liquid crystal display panel to display the image;

a voltage detector detecting a voltage level of the output voltage signal and providing a feedback signal indicating whether the voltage level exceeds a predetermined threshold; and a controller receiving the feedback signal from the voltage detector and outputting control signals to the means for supplying the data signal and the means for supplying the output voltage signal to adjust a time interval between the output voltage signal and a start of the data signal.

24. The LCD device of claim 23, wherein the means for supplying the output voltage signal comprises a DC/DC converter receiving a supply voltage and producing therefrom the output voltage signal.

25. The LCD device of claim 23, wherein the controller decreases the time interval between the output voltage signal and a start of the data signal in response to the feedback signal indicating that the voltage level does not exceed the predetermined threshold.

26. The LCD device of claim 25, wherein the controller decreases the time interval between the output voltage signal and a start of the data signal by a fixed offset, β.

27. The LCD device of claim 25, further comprising an alarm which alerts a user of a malfunction when the time interval between the output voltage signal and a start of the data signal is decreased to within a predetermined time interval α.

28. A method of driving a liquid crystal display (LCD) device, comprising:

providing a data signal for displaying an image on the liquid crystal display panel;

supplying an output voltage signal used to drive the liquid crystal display panel to display the image;

detecting a voltage level of the output voltage signal;

providing a feedback signal indicating whether the voltage level exceeds a predetermined threshold; and in response to the feedback signal, adjusting a time interval between the output voltage signal and a start of the data signal.

29. The method of claim 28, further comprising performing a software reset for a computer associated with the LCD device.

30. The method of claim 28, wherein adjusting the time interval between the output voltage signal and a start of the data signal comprises decreasing the time interval between the output voltage signal and the start of the data signal in response to the feedback signal indicating that the voltage level does not exceed the predetermined threshold.

31. The method of claim 30, wherein the time interval is decreased by a fixed offset, $\beta$.

32. The method of claim 30, further comprising alerting a user of a malfunction when the time interval between the output voltage signal and the start of the data signal is decreased to within a predetermined time interval $\alpha$.

* * * * *